United States Patent [19]

Seegmiller

[11] Patent Number: 4,776,729

[45] **Date of Patent: * Oct. 11, 1988**

[54] TRUSS SYSTEMS AND COMPONENTS THEREOF

[76] Inventor: Ben L. Seegmiller, 3500 Loren Von Dr., Salt Lake City, Utah 84124

[ * ] Notice: The portion of the term of this patent subsequent to May 12, 2004 has been disclaimed.

[21] Appl. No.: 944,930

[22] Filed: Feb. 27, 1987

Related U.S. Application Data

[62] Division of Ser. No. 06/809,139, Dec. 16, 1985, Pat. No. 4,666,344.

[51] Int. Cl.[4] ..... E21D 20/00; E21D 21/00

[52] U.S. Cl. ..... 405/288; 405/259; 299/11; 52/225

[58] Field of Search ..... 405/148, 258–261, 405/288, 290; 299/11; 52/225, 226

[56] References Cited

U.S. PATENT DOCUMENTS

| | | | |
|---|---|---|---|
| 1,686,910 | 10/1928 | Frease | 52/226 |
| 3,427,811 | 2/1969 | White | 405/259 |
| 3,505,824 | 4/1970 | White | 405/259 |
| 4,349,300 | 9/1982 | Kelley | 405/259 X |
| 4,395,161 | 7/1983 | Wilson et al. | 405/259 |
| 4,498,816 | 2/1985 | Korpela et al. | 405/259 |
| 4,596,496 | 6/1986 | Tyrell et al. | 405/259 X |
| 4,630,974 | 12/1986 | Sherman | 405/288 |
| 4,632,605 | 12/1986 | Tucker | 405/259 |
| 4,666,344 | 5/1987 | Seegmiller | 405/259 |
| 4,699,547 | 10/1987 | Seegmiller | 405/288 |

FOREIGN PATENT DOCUMENTS

| | | | |
|---|---|---|---|
| 1072893 | 6/1967 | United Kingdom | 405/288 |

*Primary Examiner*—Randolph A. Reese
*Assistant Examiner*—John A. Ricci
*Attorney, Agent, or Firm*—M. Ralph Shaffer

[57] ABSTRACT

Truss systems and components thereof for use in connection with supporting rock formations in underground mines, caverns, storage vaults, and so forth. Multiple types of truss brackets of unique design are incorporated in the various systems which also include tensioning tie rods and anchor bolts. The truss bracket components are designed so that a minimum or no force couples are exhibited when the tie rods employed are tightened down in their interconnection between associated truss brackets. Various truss systems accommodate mine entries, two-way, three-way, and four-way passageway configurements, and so forth. Additionally, provision is made for intercoupling trusses together.

10 Claims, 4 Drawing Sheets

TRUSS SYSTEMS AND COMPONENTS THEREOF

This is a division of applicaion Ser. No. 06/809,139, filed Dec. 16, 1985 of same title, now U.S. Pat. No. 4,666,344.

FIELD OF INVENTION

The present invention relates to truss systems and components thereof for supporting and retaining rock formations as are found in hardrock mines, trona mines, coal mines, underground caverns, storage vaults, passageways, and so forth. The truss components, generally in the form of truss brackets, are uniquely designed so as to maximize stability and integrity of the components and their systems, when such systems are placed in tension. Suitable rock formation anchor bolts and locking nuts therefor are provided so as to secure directly and rigidly against the exposed surfaces of applicable rock formations the bearing plate surfaces of related truss brackets.

DESCRIPTION OF PRIOR ART

Certain prior art is currently known in connection with truss systems for mines, for example. Such prior art consists of the following:

U.S. Pat. Nos.

3,427,811
3,505,824
4,349,300
4,395,161
4,498,816

British Pat. No.

899,119

BUREAU OF MINES PUBLICATION

"Evaluation of Roof Trusses, Phase I", prepared for United States Department of Interior, Bureau of Mines, by Department of Civil Engineering, University of Pittsburg, Summary Report on U.S.D.M. Grant No. G0166088, Feb. 28, 1979.

Each of the above patents and the publication listed relate to the present invention in the provision of roof trusses in general and the manner of their securement to rock formations; none of the above cited art, however, teach the unique concepts and structures as provided in the various truss bracket components of the several systems about to be described nor the manner by which trusses made up of the same, with associated tie rods, can be employed in multiple truss inter-lock systems. Additionally, none of the above cited art, taken singly or in combination, teach the virtual elimination of force couples which might otherwise act upon otherwise-designed truss brackets so as to cause their failure during the tensioning process by the associated tie rods, or subsequently.

BRIEF DESCRIPTION OF INVENTION

At the outset it is to be observed that the truss brackets, bracket combinations, and truss structures hereinbelow described in detail, can be employed to support rock formations as in hardrock mines, trona mines, coal mines, and at such uses thereof can be extended to include supporting of mine roofs, ribs, floors, underground caves, tunnels, storage vaults, toxic waste repositories, underground power stations and caverns, and any other usage wherein earth or other formations are to be supported. The present invention finds particular usage in connection with the supporting of mine roofs, however.

Principal bracket members of the truss systems hereinbelow described include uniquely designed end brackets, connector brackets, and support brackets. The various truss systems, while necessarily including end brackets as, for example, are useful in anchoring truss systems by suitable anchor bolts over and interior of mine ribs, yet the intermediate connector brackets and/or support brackets may or may not be used, depending upon the particular truss structure or structures to be desired. The trussing systems can accommodate mine entries, two-way, three-way, and four-way passage configurements, and so forth. Inter-bracket connection is made possible through the use of tensioning tie rods which interconnect the various brackets. The brackets themselves also include provision for anchoring the same by suitable anchor bolts or rock bolts to the actual rock formation, for example, being trussed. The support brackets themselves can be designed for three-way and four-way tie rod tensioning means, this depending upon particular trussing configurements to be desired. In fact, even more than four-way configurements can be used this depending upon the polygonal nature of the depending flange portion or portions supplied the support bracket. Intermediate connector brackets can be used herein not only as a juncture for tie rod continuations, but also as a separate anchoring means relative to the rock formation being buttressed by the truss system. All of the truss brackets herein include a supporting bearing plate and also depending flanges configured so as to accommodate mutual ties therebetween by tensioning tie rods, and also to provide a suitable anchoring of the bearing plates of the various truss brackets to the rock formation being worked. Particular use is had in connection with the plural-way support bracket contemplated herein wherein cross-trussing in various truss systems can be accommodated whereby trusses can be coupled together at, for example, a central point.

OBJECTS

Accordingly, a principal object of the present invention is to provide new and improved truss brackets.

A further object is to provide new and improved trusses and truss systems.

An additional object is to provide a modular truss system to accommodate a variety of passgeway or opening configurements.

A further object is to provide trussing components wherein force couples can be minimized, thereby deterring bracket failure during and after the tensioning process and also precluding the necessity of use of bulky bracket components.

BRIEF DESCRIPTION OF THE DRAWINGS

The present invention may best be understood by reference to the following description, taken in connection with the accompanying drawings in which:

For convenience of illustrations

FIG. 7 is a top view of a four-way passageway structure wherein truss structure in the form of a cross is used herein, the multiple-way central bracket accommodating interconnection at a central support point.

FIG. 8 is similar to FIG. 7 but illustrates the intermediate connector brackets as being removed, this being suitable for passageway widths which are somewhat restricted.

FIG. 9 is a top plan similar to the structure of FIG. 7 but illustrating the central, multiple-way truss bracket as having, as its polygonal shape, a generally triangularly-shaped flange to accommodate the three-way connection of tie rod means leading to intermediate truss connector brackets.

FIG. 10 is similar to FIG. 9 but illustrates direct connection of the central truss support bracket to the truss end brackets anchored to the various portions shown of the rock formation accommodated.

FIG. 13 is a top plan of alternate truss structure wherein the central tie rods used are simply crossed.

FIG. 14 illustrates the trussing of an entry, for example, by plural trusses of the type described herein.

FIG. 15 is similar to FIG. 14 but illustrates plural, parallel mutually-spaced trusses as being employed without the usual truss connector brackets and truss support brackets.

FIG. 16 is a top plan in diagrammatic form of an interlocked trussing system incorporating plural parallel trusses and cross trussing structures wherein the truss support brackets that are centrally disposed are interconnected together by suitable tensioning tie rods means.

DETAILED DESCRIPTION OF PREFERRED EMBODIMENTS

Figure 1:
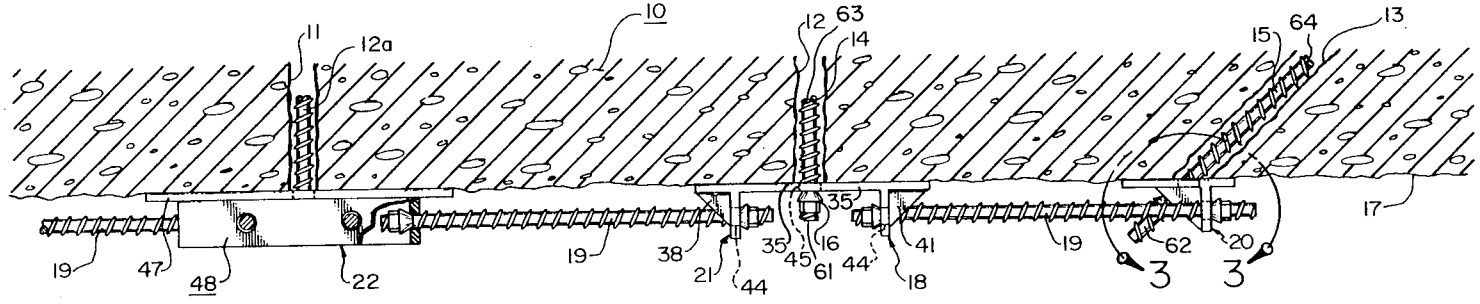
FIG. 1 is a side view and partially sectioned and shown in fragmentary form, of a representative truss structure half including one of the two end brackets employed, one intermediate connector bracket, and a central, plural-way support bracket; it will be understood that, disposed to the left of the left-located support bracket, there will be included a similar connector bracket followed by an end bracket, this is to complete the multiple bracket tie-rod structure.

In FIG. 1 rock formation 10 is seen to include plural bore holes or apertures 11, 12, and 13 that individually receive a series of rock bolts or anchor bolts 12*a*, 14 and 15. These rock bolts will be secured in place by the conventional resin anchor used in connection with rock bolts in general, by cementitious matter, or by other means. The individual rock bolts are preferably threaded and include locking nuts 16 threaded thereon. Secured to and between such rock bolts for supporting surface 17 of rock formation 10 is a truss structure 18, the same incorporating a series of tie rods 19 and truss brackets 20, 21, and 22. For convenience of nomenclature, truss bracket 20 will-be referred to hereinafter as an "end bracket", this for convenience; correspondingly, truss bracket 21 will be referred to as a "connector bracket"; and truss bracket 22 will be termined a "plural-way support bracket". The details of end bracket 20 are best seen in FIGS. 3 through 6 which will now be considered.

Figure 4:
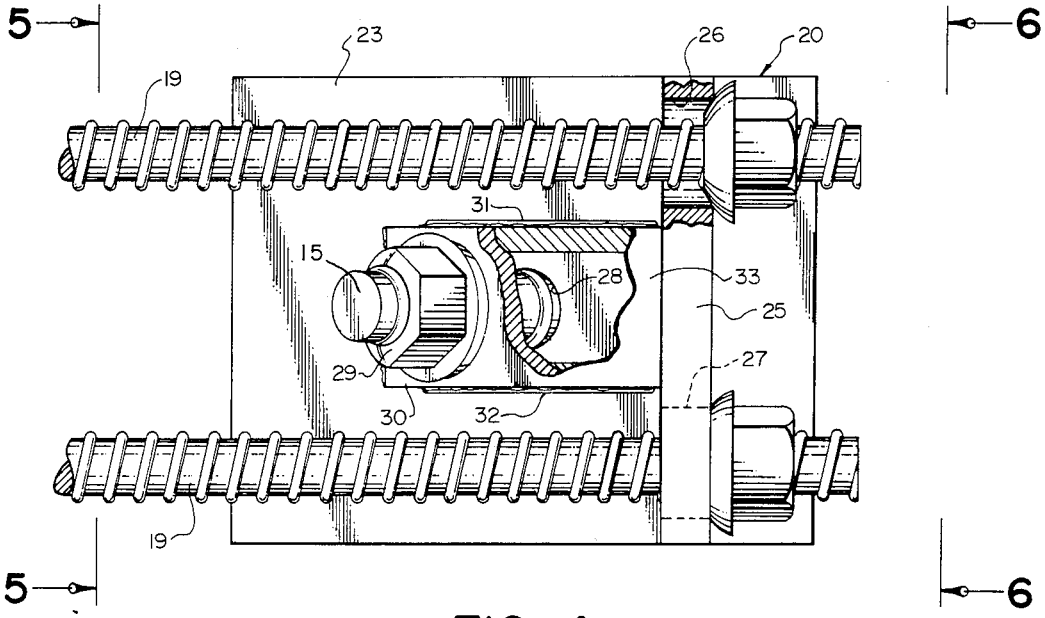
FIG. 4 is a bottom plan of the structure of FIG. 3.
Figure 5:
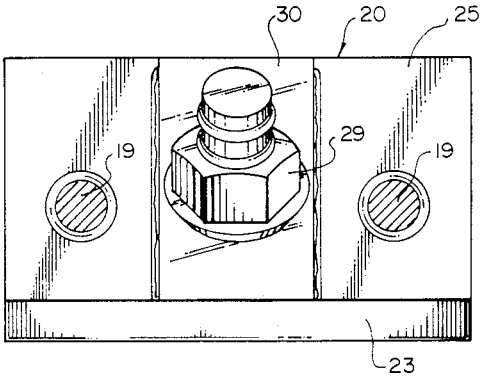
FIG. 5 is an intermediate end view of the structure of FIG. 4 and is taken along the line 5—5 in FIG. 4.
Figure 6:
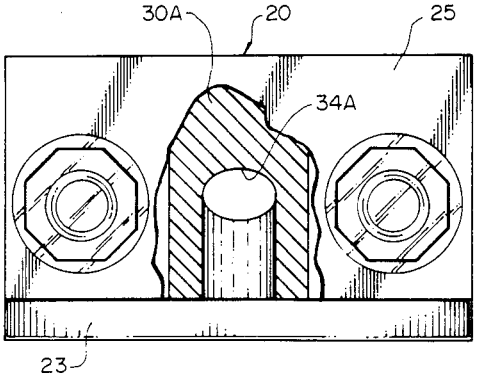
FIG. 6 is an outermost end view of the truss end bracket shown in FIG. 4 and is taken along the line 6—6 in FIG. 4; for convenience of illustration the structure in FIG. 6 is partially broken away and sectioned.

End bracket 20 includes a bearing plate 23 having upper supporting surface 24. Depending from and integral with bearing plate 23 is a depending flange 25, the latter having a pair of tie rod admittance apertures 26 and 27. In a preferred form of the invention, the depending flange 25 will be separate from but will be welded to the undersurface of bearing plate 25. Bearing plate 23 also includes an aperture 28 for receiving anchor bolt 15, the latter being provided with securement nut 29. Gusset portion 30 is welded to the inner surfaces of bearing plate 23 and depending flange 25. This gusset portion may be solid, as seen at 30A in FIG. 6, or may be comprised of a pair of gusset members 31 and 32 which are welded to bearing plate 23 and depending flange 25, and also welded and thus joined to an overlapping strap or plate 33 as seen in FIG. 4. In any event, the outer appearance and general function of gusset portion 30 will be the same as generally indicated in FIG. 5. Aperture 34 will be supplied in plate 33 to accommodate anchor bolt 15 and aperture 34A will be provided lin the solid gusset portion of FIG. 6 where this embodiment is employed. Suitable spec welding will be used to achieve the greatest strength as to the joining of depending flange 25 to bearing plate 23 and also the individual or several elements of gusset portion 30 relative to the bearing plate and depending flange. While it is possible that end bracket 20 can be cast, much greater strength and less bulkiness can be achieved where the end bracket 20 is fabricated by separate parts in the manner hereinabove described, to be welded together.

Figure 2:
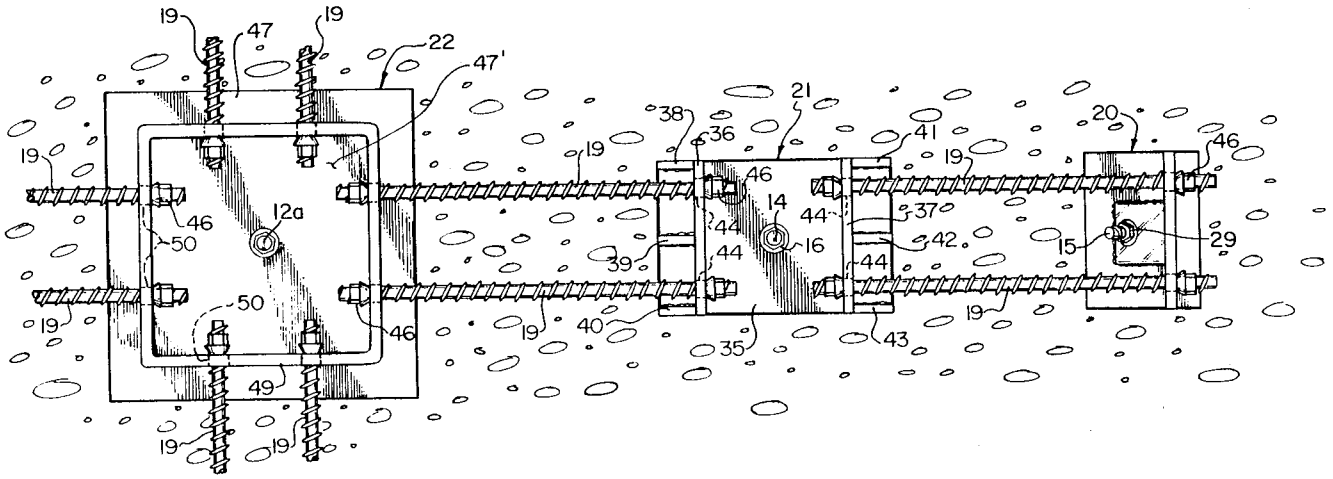
FIG. 2 is a bottom plan view of the structure shown in FIG. 1.
Figure 3:
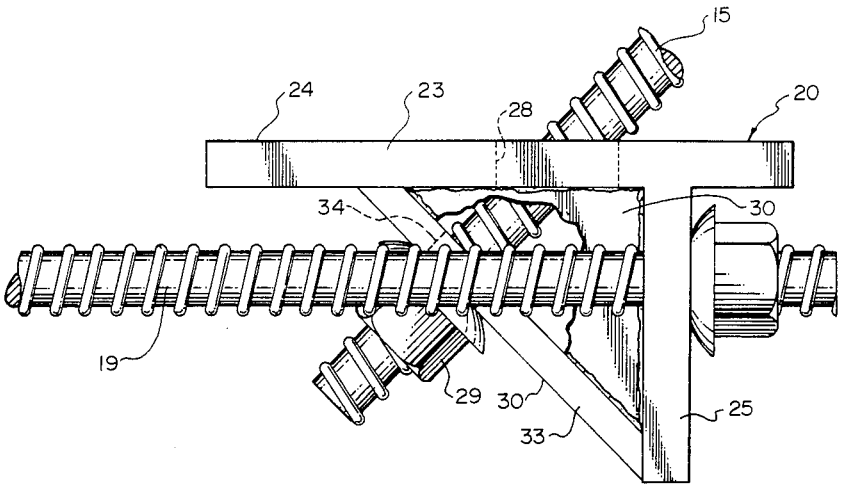
FIG. 3 is a fragmentary detail taken along the arcuate line 3—3 in FIG. 1 illustrating the configurement of the truss end bracket used herein.

Returnning now to FIGS. 1 and 2 it is seen that connector bracket 21 includes a bearing plate 35 and a pair of depending flanges 36 and 37 welded thereto. Likewise provided are a series of gussets 38–43 that are welded in place in the manner indicated in FIG. 2. A series of apertures 44 will be supplied in the two depending flanges 36 and 37 to accommodate the ends of tie rods 19. Likewise, aperture 45 will be supplied in the bearing plate to accommodate upwardly oriented rock bolt 14 as secured to the bearing plate by locking nut 16. The ends of all of the tie rods will be provided with similarly or identically configured locking nuts 46.

In turning now to the left-hand portions of FIGS. 1 and 2, it is seen that the remaining truss bracket, namely plural-way support bracket 22 includes a bearing plate 47 and, welded to the undersurface thereof, depending polygonal flange 48 formed of several joined-together flange portions 39. While the several flange portions may be separate and gusseted, it is highly preferred that a unitary structure can be used in connection with flange 48, this to supply maximum strength or holding power for the structure. Flange 48 will be welded at its interior and/or exterior sides to the underside 47′ of bearing plate 47. A series of apertures 50 will be supplied in the several flange portions 49 to accommodate the various tie rods 19, the ends of the same being routed therethrough and secured by nuts 46, by way of example.

Figure 7:
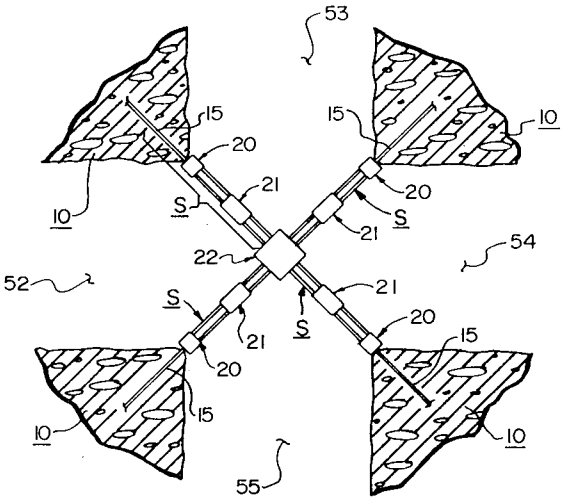

Broadly, the truss structures of FIGS. 1 and 2 are shown in fragmentary view and include, to the left of the plural-way support bracket 22 an additional connector bracket 21 and end bracket 20 so that the structure, when in its complete form, will assume the appearance of four-way truss structure 51 in FIG. 7 when the same is employed as a four-way truss structure relating to the four passageways 52,53, 54, and 55 that join together as seen in FIG. 7. Thus, the structure is not only elongate in one longitudinal direction, but additionally represents a cross-type structure having a second lateral direction. The various truss brackets 20, 21, and 22 are identified in FIG. 7, with the various tie rods connecting the truss together, the four ends of the truss may be secured by the four anchor bolts or rock bolts 15.

Figure 11:
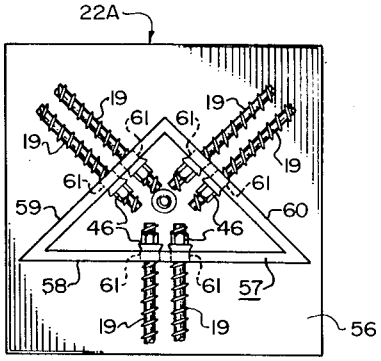
FIG. 11 is a bottom plan of the truss support bracket of FIGS. 9 and 10.
Figure 12:
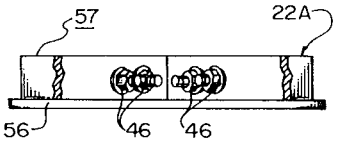
FIG. 12 is an end view of the structure of FIG. 11 and is broken away for convenience of illustration.
Figure 9:
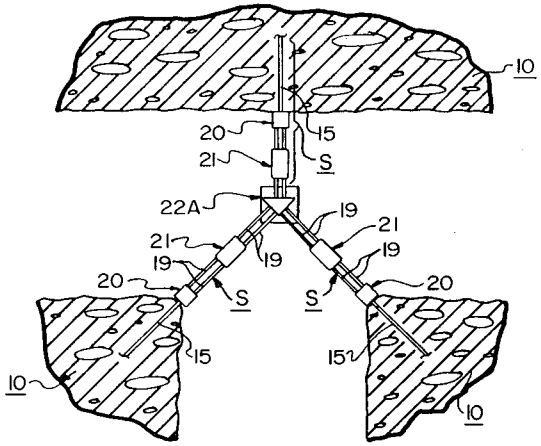
FIGS. 7–10, and 13–16 are top plans, partially sectioned, and in diagrammatic form, illustrating various passageway configurations which can be trussed by employing any one of the truss systems herein described.
Figure 10:
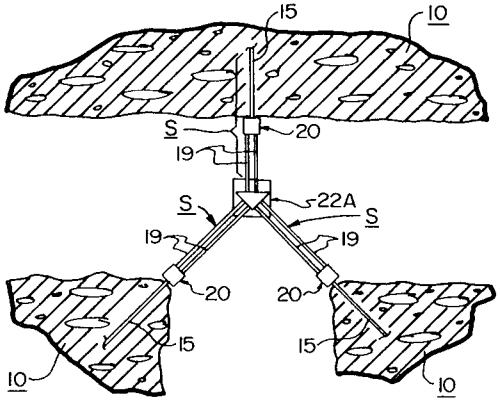
Figure 8:
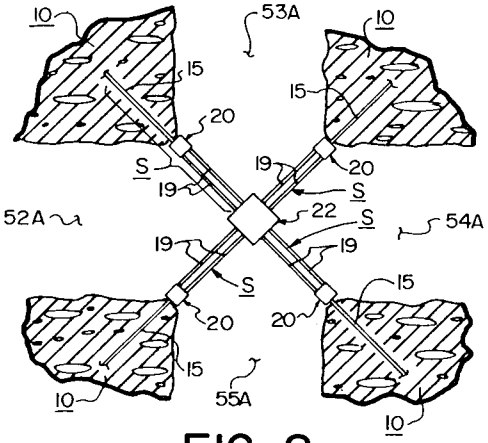

In contrast with FIG. 7, FIG. 8 illustrates that where the width of the corresponding passageways 52A–55A is somewhat reduced, then it is conceivable that the truss brackets 21, namely, the connector brackets of FIG. 2, can be eliminated. In such event the central, plural-way support bracket 22 is employed in connection with tie rods connecting the same to the end brackets 20. FIGS. 9 and 10 illustrate suitable structure of the invention to accommodate three-way passageways in rock structures. Here the plural-way support bracket 22 is modified to the configuration shown at 22A in FIGS. 9–12. Thus, support bracket 22A, corresponding to the support bracket 22 in FIG. 7, this time includes bearing plate 56 and, secured thereto and depending therefrom, a depending polygonal flange 57 formed of inter-connected or interjoined flange portions 58, 59, and 60. The flange will preferably be wleded to bearing plate 56, and will include at its respective flange portions a series of apertures at 61 to accommodate the several tie rods 19. Tie rods 19 again will be tensioned and secured in place by nuts 46 as threaded onto the individual tie rods. Thus, the structure of FIG. 11 may be secured in place as to the embodiments shown in FIGS. 9 and 10, either with the inclusion of connector brackets 21 as seen in FIG. 9, or with their eliminatin and the simple connection of tie rods 19 directly from support bracket 22A to end truss brackets 20.

It is conceivable for some passageways-accommodating truss structures that the central plural-way support bracket 22 can be eliminated, this particularly where passageway size is not great. In such event, one or more connector brackets 21 can be employed in combination with the aforementioned tie rods 19, with the tie rods being secured in place and tensioned by the aforementioned securement nuts 46 (not shown). At approximately the midpoint of the passageway structure, one set of tie rods will simply pass over the remaining central set as seen in FIG. 15.

Figure 14:
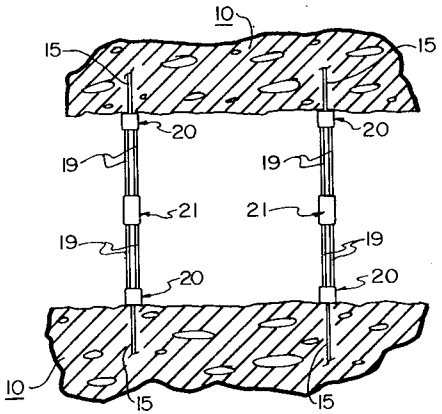
Figure 15:
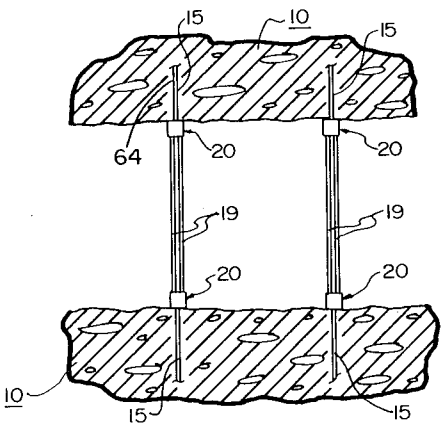
Figure 13:
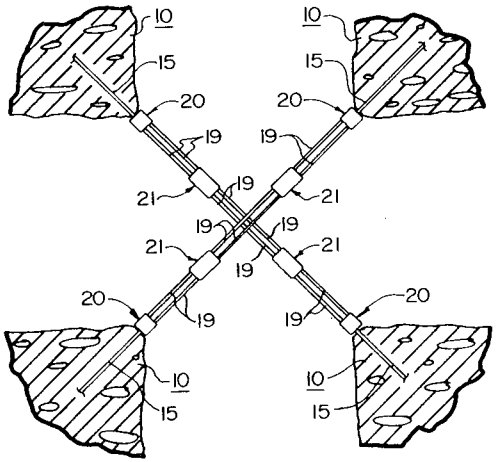

For passageways and/or entries as seen in FIG. 14, the truss structure may take the form of that seen in FIG. 15. Accordingly, the connector brackets 21 are employed to support the central portion of the roof structure, by way of example. The end brackets 20 will be secured in place in the manner shown in FIG. 1. Where passageway width is sufficiently reduced, then it is conceivable that the connector structure be eliminated and the two end brackets 20 simply joined together by a single pair of tie rods 19. This latter structural truss condition is seen in FIG. 15.

Figure 16:
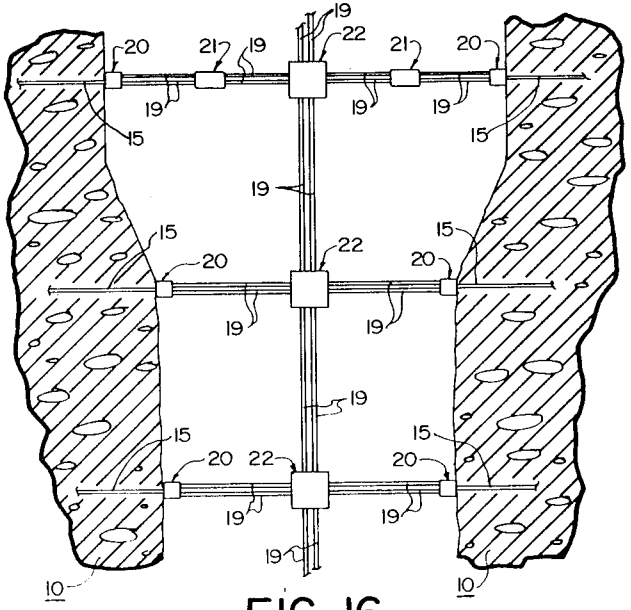

Additionally, to add pre-tensioned rigidity to the structure, the truss brackets are connected together in the several manners indicated, and the tension tie rods tightened down by the cooperating attachment nuts 46. That serves to increase compressive forces in the roof structure of the formation so as to support such roof structure and tend to eliminate roof droppings or cave-ins. Note FIG. 16.

In FIGS. 1, 2 and 15, by way of example, each of the rock or roof bolts and anchor bolts 14 and 15, respectively, have respective proximate end 61, 62, which comprise enlarged bracket-retention extremeties as by nuts 16, 29, and also distal ends 63, 64. When the overall truss structure is placed in tension, as by the tightening of tie rod nuts 46 in FIG. 2 and when the various bolts are placed in tension as by tightening of nuts 16 and 29 so as to cause brackets 20 and 21 to thrust against roof structure 17, then the roof strata above the exposed roof surface 17 will be placed in compression. This occurs not only by the action of the pre-tensioned tie rods 19, but also by the action of the now-tightened nuts 16 and 29 and the consequent placing of the bolts 14 and 15 in tension. This increases the volume of the compression stress field in the proximate roof strata. Specifically, the tensioned bolt 14 will produce at its distal end 63 a force vector component which will be directed substantially toward the junction of the end bracket 20 and right tie rod 19 in FIG. 1, which will coact with the resultant force vector at such juncture as produced by the tensioning of the tie rod 19 and bolt 15, thereby placing in compression roof strata material therebetween. Accordingly, this serves to place a substantially enlarged area of the roof strata in compression, further aiding in preventing the fall-out of roof material. Nuts 16 and 29 show one form of enlarged lower extremeties of the respective bolts 14 and 15. Relative to FIGS. 7–10, by way of example, the spokes S are in tension by tie rods 19 and extend radially outwardly from bracket or connection member 22, 22A; such spokes include outwardly and upwardly canted portions comprising the anchoring bolts 15.

It will be understood that the present invention contemplates usage thereof as floor trusses, roof trusses, intersection trusses, and entry trusses, by way of example.

A final word as to connector bracket 21: it is seen that the opposite ends thereof on either side of the bracket are outwardly-spaced relative to the depending flanges welded to the bearing plate and provide their support thereto with the several welded gussets shown. Also, by the use of gusset pairs in the structures shown, force couples are essentially eliminated.

In assembly, the anchor bolts are first installed in the rock formation; then the truss brackets are loosely installed thereon. Subsequently, the tie rods are loosely installed. Then the anchor bolt nuts are tightened down. And finally, the tie rods are tensioned by turning down their respective nuts.

While particlar embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In combination: a rock-formation having a passageway; plural side-by-side mutually spaced, parallel pre-tensioned elongated truss structures secured in pretension to said rock formation in a direction transverse to the longitudinal axis of said passageway over an exposed surface thereof, plural, elongate, pretensioned tie-rod means disposed within said passageway for rigidly and pretensioningly interconnecting adjacent ones of said truss structures in a direction transverse to the orientation of said truss structures, said truss structures each including: plural, opposite, mutually spaced truss end brackets, anchor bolt means pretensioningly securing said truss end brackets to and against said rock formation, and pretensioning tie rod structure, having tightening nuts engaging said brackets, disposed essentially between said anchor bolt means, intercoupling said brackets, and secured transversely in pretension to a respective one of said elongate pretensioned tie-rod means.

2. A method for active systemic roof control of native roof strata in a mine opening, having opposite sides and an upper roof surface spanning said sides, including the steps of arranging elongated tensile structure proximate and beneath said upper roof surface, arranging for connection to and interposition within said elongated tensile structure a reactive bearing element positioned against said upper roof surface, securing upwardly-and-outwardly-extending angulated anchors, having distal ends, in said roof strata at said distal ends, oppositely and transversely beyond the sides of said mine opening, coupling said elongated tensile structure to and between said anchors under pre-stressed pretensioned condition as to both said anchors and also as to said elongated tensile structure, for compression stressing said roof strata between said anchors, said elongated tensile structure and said anchors forming common junctures, providing tensionable pretensioned vertical anchor structure, having an upper distal end, above and coupled to said bearing element for forcibly urging said bearing element against said roof surface and for additionally supplying compressive stressing in said roof strata between said bearing element and said distal end of said anchor structure and also between said distal end of said anchor structure and said junctures of said anchors with said elongated tensile structure.

3. For actively supporting the roof of a mine passageway having said roof, opposite sides contiguous with said roof, and roof strata disposed over said roof and extending transversely beyond said sides, in combination: a series of essentially parallel, side-by-side mutually spaced pretensioned elongated truss structures constructed for anchoring into said roof strata oppositely beyond said sides, said truss structures having opposite extremities disposed adjacent said sides and beneath said roof and also pretensioned angulated anchor bolts retentively engaging said extremities and so anchored in pretension in said roof strata; pretensioned tie rod means fastened transversely to said truss structures for respectively pretensioningly intercoupling said truss structures; and separate, plural, vertical pretensioned anchor bolt structures having distal ends and secured distally at said distal ends in pretension essentially between said sides above said mine roof in said roof strata between corresponding opposite ones of said anchor bolts, said anchor bolt structures also retentively engaging respective ones of said truss structures and precompressing intermediate portions of respective ones of said truss structures against said mine roof, whereby also actively to create compressive forces in said roof strata between the so anchored said distal ends of said pretensioned anchor bolt structures and said extremities of said pretensioned truss structures.

4. A method of active systemic roof control at a mine openings' intersection defined by intersecting passageways having a common intersection roof, said roof having a downwardly facing, exposed roof surface, said method comprising the steps of: providing a bearing plate structure for bearing engagement with said roof surface; thrustingly anchoring, by a vertical pretensioned rock bolt structure having an anchored rock bolt distal end and a proximate end retentively thrustingly engaging said bearing plate structure, said bearing plate structure thrusting against said roof surface; providing a pretensioned trussing structure having opposite ends, in which said bearing plate structure is structurally interposed and incorporated; and providing distally anchored pretensioned angulated rock bolts having proximate ends retentively engaging said opposite ends of said trussing structure and pretensioningly anchored in said roof, for generating a compression zone in said roof between said angulated rock bolts and proximate said vertical rock bolt.

5. The method of claim 4 wherein said trussing structure has an X configuration with a central intersection point and wherein said providing step comprises providing said bearing plate structure at said intersection point of said X configuration.

6. The method of claim 4 wherein said trussing structure has a Y configuration with a central intersection point and wherein said providing step comprises providing said bearing plate structure at said intersection point of such Y configuration.

7. An active mine roof pretensioned trussing structure for preloading in compression and trussing a mine roof with its roof strata therabove, and including, in combination: pretensioned plural threaded tie rods provided with tie rod tensioning nuts at opposite ends thereof, a mine roof support bracket centrally bearing against said mine roof and having side apertures receiving selected one of said tie rods and reaction surfaces engaging selected ones of said nuts, said support bracket being provided with a roof bolt aperture, an upstanding threaded roof bolt passing through said roof bolt aperture, anchored in said roof strata, and provided with a tensioning nut thrustingly engaging said support bracket for pre-tensioning said roof bolt, plural end brackets mutually spaced from and about said support bracket and having apertures receiving said tie rods and provided with reaction surfaces engaging selected ones of said nuts, said end brackets also having angulated anchor bolt receiving apertures, upwardly and outwardly angulated threaded anchor bolts anchored in said roof strata, passing through said end bracket anchor bolt receiving apertures, and having end nuts threaded thereon and thrustingly engaging said end brackets for pre-tensioning said anchor bolts and thrustingly retaining said end brackets against said mine roof, said tie rod nuts being tightened for pre-tensioning said tie rods, whereby to place said trussing structure in pretensioned active condition independent of roof load.

8. A method for actively trussing a mine roof having roof strata thereabove, including the steps of: providing plural threaded tie rods provided with tie rod tensioning nuts at opposite ends thereof, providing a mine roof support bracket centrally bearing against said mine roof and having side apertures receiving selected ones of said tie rods and reaction surfaces engaging selected ones of said nuts, said support bracket having a roof bolt aperture; providing an upstanding threaded roof bolt passing through said roof bolt aperture, anchored in said roof strata, and having a tensioning nut for thrustingly engaging said support bracket for pre-tensioning said roof bolt; providing plural end brackets mutually spaced from and about said support bracket and having apertures receiving said tie rods and having reaction surfaces engaging selected ones of said nuts, said end brackets also having angulated anchor bolt receiving apertures; providing upwardly and outwardly angulated threaded anchor bolts anchored in said roof strata, passing through said end bracket anchor bolt receiving apertures, and having end nuts threaded thereon and engaging said end brackets, for pre-tensioning said anchor bolts and thrustingly retaining said end brackets against said mine roof; and tightening all of said nuts whereby to place said anchor bolts, roof bolt, and tie rods in tension, and thereby place said trussing structure in pre-tensioned active condition independent of roof load.

9. A method for actively trussing a mine roof having roof strata thereabove, including the steps of: providing plural threaded tie rods provided with tie rod tensioning nuts at opposite ends thereof, providing a mine roof support bracket centrally bearing against said mine roof and having side apertures receiving selected ones of said tie rods and reaction surfaces engaging selected ones of said nuts, said support bracket having a roof bolt aperture; providing an upstanding roof bolt passing through said roof bolt aperture, anchored in said roof strata, and having an enlarged extremity for engaging said support bracket; providing plural end brackets mutually spaced from and about said support bracket and having apertures receiving said tie rods and having reaction surfaces engaging selected ones of said nuts, said end brackets also having angulated anchor bolt receiving apertures; providing upwardly and outwardly angulated anchor bolts anchored in said roof strata, passing through said end bracket anchor bolt receiving apertures, and having enlarged extremities engaging said end brackets, for retaining said end brackets against said mine roof; and tightening said tie rod nuts whereby to place said tie rods in tension, and thereby place said trussing structure in pre-tensioned active condition independent of roof load.

10. An active roof truss for trussing mine roof strata, including, in combination: a connection member having an interior aperture; a pretensioned vertical roof bolt passing through said interior aperture, retentively engaging said connection member, and extending upwardly therefrom for anchoring into said mine roof strata; and a plurality of pretensioned truss spokes tensioningly secured to, arcuately mutually spaced about, and extending radially outwardly from said connection member, each of said spokes having an upwardly and outwardly canted extension constructed for securement in said mine roof strata.

* * * * *